US007787964B2

(12) United States Patent
Schuette et al.

(10) Patent No.: US 7,787,964 B2
(45) Date of Patent: Aug. 31, 2010

(54) OPERATING AND DISPLAY DEVICE FOR A HOUSEHOLD APPLIANCE, HOUSEHOLD APPLIANCE, AND SYSTEM

(75) Inventors: Thorsten Schuette, Paderborn (DE); Svenja Bevers, Schloss-Holte Stukenbrock (DE); Manuela Loeckmann, Verl (DE); Bernd-Udo Neiss, Bielefeld (DE); Horst Noeller, Guetersloh (DE); Markus Andert, Bielefeld (DE); Silke Seyffarth, Harsewinkel (DE)

(73) Assignee: Miele & Cie. KG, Guetersloh (DE)

( * ) Notice: Subject to any disclaimer, the term of this patent is extended or adjusted under 35 U.S.C. 154(b) by 47 days.

(21) Appl. No.: 11/695,736

(22) Filed: Apr. 3, 2007

(65) Prior Publication Data

US 2007/0233284 A1 Oct. 4, 2007

(30) Foreign Application Priority Data

Apr. 3, 2006 (DE) ..... 10 2006 015 840

(51) Int. Cl.
*G05B 11/01* (2006.01)

(52) U.S. Cl. ..... 700/15; 700/17; 700/19; 700/275; 340/679

(58) Field of Classification Search ..... 700/1, 700/17–19, 83, 15; 340/679, 825.22
See application file for complete search history.

(56) References Cited

U.S. PATENT DOCUMENTS

| | | | | |
|---|---|---|---|---|
| 6,844,807 | B2 * | 1/2005 | Inoue et al. | 340/3.7 |
| 6,850,149 | B2 * | 2/2005 | Park | 340/7.1 |
| 6,853,291 | B1 * | 2/2005 | Aisa | 340/3.3 |
| 6,924,727 | B2 * | 8/2005 | Nagaoka et al. | 340/3.1 |
| 6,956,461 | B2 * | 10/2005 | Yoon et al. | 340/310.11 |
| 7,082,341 | B2 * | 7/2006 | Lee | 700/3 |
| 7,092,768 | B1 * | 8/2006 | Labuda | 700/19 |
| 7,135,982 | B2 * | 11/2006 | Lee | 340/635 |
| 7,136,940 | B2 * | 11/2006 | Roh et al. | 710/8 |
| 7,181,291 | B2 * | 2/2007 | Boldt et al. | 700/17 |
| 7,188,002 | B2 * | 3/2007 | Chapman et al. | 700/276 |
| 2003/0100962 | A1 * | 5/2003 | Sumita et al. | 700/65 |
| 2004/0093379 | A1 * | 5/2004 | Roh et al. | 709/203 |

(Continued)

FOREIGN PATENT DOCUMENTS

DE 19615358 A1 * 11/1996

(Continued)

OTHER PUBLICATIONS

"Household Appliance, Especially Refrigerating and/or Freezing Appliance", Mar. 3, 1998, AEG Hausgeraete GMBH, Translation of DE 296 15 963.*

*Primary Examiner*—Charles R Kasenge
(74) *Attorney, Agent, or Firm*—Leydig, Voit & Mayer, Ltd.

(57) ABSTRACT

An operating and display device for a household appliance includes a display and an operating element. The display includes a number of display areas. A first of the display areas is configured to show, as summary information, a status and/or a setting of another household appliance connected so as to communicate with the household appliance. The operating element is configured to select at least one of an operating program, a parameter and a display option.

12 Claims, 5 Drawing Sheets

U.S. PATENT DOCUMENTS

2004/0117068 A1* 6/2004 Lee ..... 700/275
2004/0122531 A1* 6/2004 Atsuta et al. ..... 700/1
2004/0148632 A1* 7/2004 Park et al. ..... 725/81
2005/0154496 A1* 7/2005 Chapman et al. ..... 700/278
2005/0162273 A1* 7/2005 Yoon et al. ..... 340/310.01
2005/0184852 A1* 8/2005 Lee ..... 340/531
2005/0222859 A1* 10/2005 Ha ..... 705/1
2006/0290465 A1* 12/2006 Go et al. ..... 340/3.7

FOREIGN PATENT DOCUMENTS

| | | |
|---|---|---|
| DE | EP 742308 A1 * | 11/1996 |
| DE | 29615963 | 1/1998 |
| EP | 0740112 | 10/1996 |
| EP | 0898003 | 2/1999 |
| WO | 2004/052167 | 6/2004 |

* cited by examiner

OPERATING AND DISPLAY DEVICE FOR A HOUSEHOLD APPLIANCE, HOUSEHOLD APPLIANCE, AND SYSTEM

Priority is claimed to German patent application DE 10 2006 015 840.7, filed Apr. 3, 2006, which is hereby incorporated by reference herein.

The invention relates to an operating and display device for a household appliance, comprising a display having several fields and an operating element for selecting operating programs and/or parameters and/or display options, whereby the operating and display device is suitable for displaying statuses and/or settings of the other household appliances that are connected so as to communicate with the household appliance. The invention also relates to a household appliance having an operating and display device, comprising a display having several fields and an operating element for selecting operating programs and/or parameters and/or display options, whereby the operating and display device is suitable for displaying statuses and/or settings of the other household appliances that are connected so as to communicate with the household appliance. The invention also relates to a system consisting of a first household appliance having an operating and display device, comprising a display having several fields and an operating element for selecting operating programs and/or parameters and/or display options, and other household appliances that are connected so as to communicate with the first household appliance, whereby the operating and display device is suitable for displaying statuses and/or settings of the other household appliances that are connected so as to communicate with the first household appliance.

BACKGROUND

European patent application EP 0 740 112 A1 describes an operating and display device having a setting element and a monitor, intended for operating several household appliances that are connected so as to communicate with each other. Here, in a first step, the household appliance to be operated is selected, after which the settings can be implemented. Each setting option is associated with a corresponding display, whereby each setting appears on the monitor according to a display position. The operating and display device can be integrated into one of the household appliances that are connected so as to communicate with each other.

International patent application WO 2004/052167 A1 describes a display device that can show data about the status of a household appliance, for example, a dishwasher, such as the remaining running time and/or the program status. The display device is configured separately from the dishwasher and can be operated remotely from it. The data is transmitted via a data-transfer system that can run on the household power supply network. When several household appliances are in operation, an operating element is employed to select the household appliance whose status data is output or displayed on the remote display device.

European patent application EP 0 898 003 A2 describes an operating and display device for a washing machine that comprises a display with several lines that serve to show programs or program parameters that can be selected. The selection is made by means of an operating element that corresponds to the depiction or to the display elements in the display, whereby the selected program or parameter is activated by an additional entry, for instance, by pressing an "Enter" button. The display is particularly well-suited for showing selectable programs in plain text.

Therefore, it is described in the state of the art to employ an operating and display device in order to select the settings or operating programs and/or parameters for one or more household appliances that are connected so as to communicate with each other. In order to centrally obtain information about the statuses of all of the household appliances, a centrally arranged display is known that shows the statuses of the connected household appliances. Here, it is necessary to select the household appliance that is to be monitored, or else an autonomous display appears when a status has been set in a household appliance that requires action on the part of the operator. This type of display is often felt to be confusing or else the selection of the household appliance that is to be monitored is felt to be awkward.

SUMMARY

Therefore, the invention includes as an object improving the display of statuses and/or settings of several household appliances in a central display device.

The present invention provides an operating and display device for a household appliance. The operating and display device includes a display and an operating element. The display includes a plurality of display areas, a first display area of the display areas being configured to show, as summary information, at least one of a respective status and a respective setting of another household appliance connected so as to communicate with the household appliance. The operating element is configured to select at least one of an operating program, a parameter and a display option.

BRIEF DESCRIPTION OF THE DRAWINGS

An embodiment of the present invention is shown schematically in the drawings and will be described in greater detail below. The following are shown.

DETAILED DESCRIPTION

Figure 1:
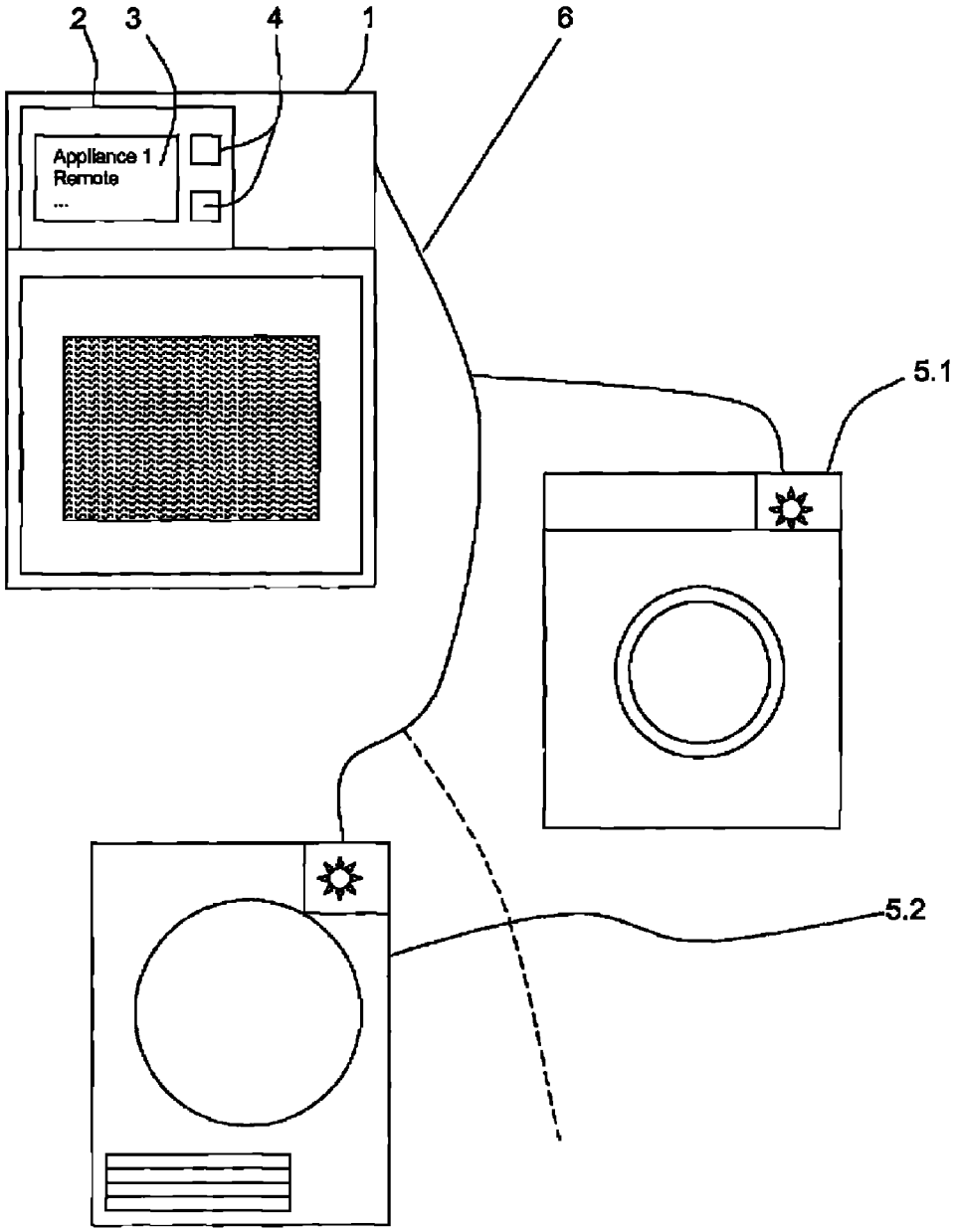
FIG. 1—a system with household appliances that are connected so as to communicate with each other.

Advantages that can be achieved with the invention include, in addition to a clear depiction of the statuses or settings of several household appliances that are connected so as to communicate with each other, the fact that detailed information about statuses and/or settings can be displayed. For this purpose, an operating and display device is provided that has a display with several fields or display areas, and an operating element for selecting operating programs and/or parameters and/or display options. The display encompasses at least one display area where statuses and/or settings of the household appliances can be shown as combined information. This combined display has the advantage that the operator can be alerted to the presence of relevant statuses at any time.

In this context, it is advantageous for an operating and display device to be integrated into a first household appliance and for it to be available for the operation and display of statuses and/or settings of the first household appliance, whereby the operating and display device communicates with other household appliances situated remotely. If it is integrated into an oven or a stove, the operating status or the settings of household appliances that are situated remotely or that are difficult to access can be conveniently monitored.

In another embodiment, the statuses and/or settings of the remote household appliances are combined along the lines of an OR logic operation, whereby they can be displayed in a separate display area as combined information, independently of the status or setting of the first household appliance such as, for example, an oven. As a result, the operator can be informed at all times about the statuses of the remote household appliances that are not within direct view, whereby the combined information only indicates the presence of relevant statuses or settings. If all of the remote household appliances are switched off or in a non-relevant state (standby), the result of the OR logic operation is an inactive state that is output as information. If one or more of the remote household appliances are switched on or are in a relevant state, the result of the OR logic operation is an active state that is output as information. The separate display area or field is not intended for the operation or display of the household appliance that is to be operated, so that the operation of the separate display area or display field or of the output of information via the separate display field remains unaffected.

In an advantageous embodiment, the separate field can be selected via the operating element, as a result of which the statuses of the remote household appliances can each be displayed in a separate display field or area as a display option instead of a display of the operating programs and/or parameters of the first household appliance. Here, for instance, a line is provided for each household appliance and the status of the household appliance associated with that line can be displayed. The information can be output in plain text, as a result of which the user is saved the trouble of having to read the operating manual. Here, a multiple-line display is particularly suitable on which the statuses of several household appliances can be shown simultaneously. If the display contains fewer lines than the number of household appliances that are to be monitored, non-visible lines can be moved into the visible display area by using a so-called scroll function. This measure makes it possible to employ an above-mentioned display with, for instance, five lines, creating a detailed display of the status of more than five household appliances, one line being provided for each household appliance. The detailed display of the individual household appliances can be switched off again via the operating element. Subsequently, the display is once again functionally associated with the first household appliance and the statuses of the remote household appliances can again be shown in a separate display area or in a display field in the display as combined information. The modality for selecting the display option corresponds essentially to the operating approach of the household appliance associated with the operating and display device. This allows the user to set the display options in a simple manner.

In an advantageous refinement of the invention, it is proposed that the status of the first household appliance can be shown simultaneously with the remote household appliances in a separate display field by means of the appropriate display fields within the display. In this manner, the status of the household appliance containing the operating and display device can be monitored at the same time as the remote household appliances.

FIG. 1 shows a household appliance 1 that is connected for data exchange with other remotely situated household appliances 5.1. and 5.2 via a communication link 6. Wireless, hard-wired data-exchange systems or bus systems or else the familiar Powerline data-exchange system, which provides data transmission via the household power supply network, can all be employed as the communication link. The first household appliance 1 is, for instance, an oven that is set up or installed in a place in the kitchen that is easily accessible to the user. The operating and display device 2 is easily accessible and clearly visible to the user. A conceivable remote household appliance is, for example, a washing machine 5.1 and a dryer 5.2, which are located in a different room, for example, in the basement. The remote household appliance or the washing machine 5.1 is associated with operating and display device 7.1, the dryer 5.2 is associated with operating and display device 7.2. The laundry programs and/or parameters for the laundry cycle to be run in the washing machine 5.1 can be set via the operating and display device 7.1. The drying programs and/or parameters for the drying cycle to be run in the dryer 5.2 can be set via the operating and display device 7.2. The statuses or settings such as, for instance, the selected program and/or parameters of the washing machine 5.1 or dryer 5.2 can be transmitted in encoded form to the first household appliance 1 via the communication link 6. In each case, this is performed by devices inside the appliances 1, 5.1, 5.2 via, for example, so-called interfaces. The oven 1, which functions as the first household appliance, encompasses an operating and display device 2 with a display 3 that provides the depiction of several lines or fields 7.

The actual function of the first household appliance 1 is not decisive for the operating and display device 2 according to the invention. A dishwasher or a microwave oven can also be provided as the first household appliance 1. The only important aspect is that the operating and display device 2 has to be arranged so that it can be seen clearly and/or conveniently. This is usually the case when the operating and display device 2 is situated at a convenient working height in the kitchen.

Figure 2A:
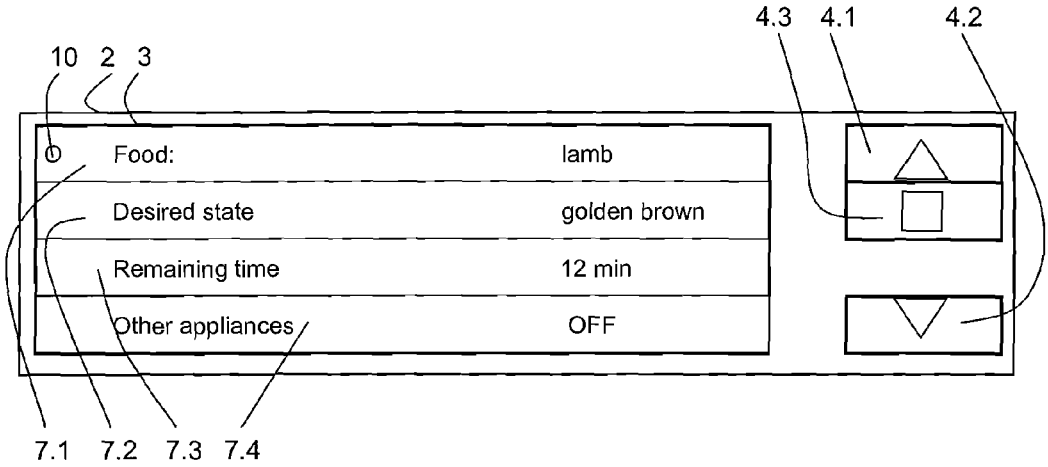
FIGS. 2*a*-2*d*—an operating and display device.

FIG. 2*a* shows, for example, the operating and display device 2 of the oven 1, comprising a display 3 and at least one operating element 4 that, in conjunction with the display 3, provides a selection of programs and/or parameters. The arrow buttons 4.1, 4.2 on the operating element 4 can be used to select a display or output in plain text through the modality of highlighting, for instance, with an illuminated frame, so that the setting and/or parameter that controls the program can be actuated by subsequently pressing the enter button 4.3. Field 7.1 indicates the type of food to be baked, field 7.2 shows, as an additional setting, that the desired baking result is "golden brown". Field 7.3 is connected to the program controls and shows the current status or, in this example, the time remaining, for example, in minutes, until the baking process is finished. Field 7.4 is provided as a display area for combined information for remote household appliances 5.1, 5.2. According to FIG. 2*a*, no remote household appliances are switched on or are in operation, so that the combined information is displayed as "Other appliances OFF".

Figure 2B:
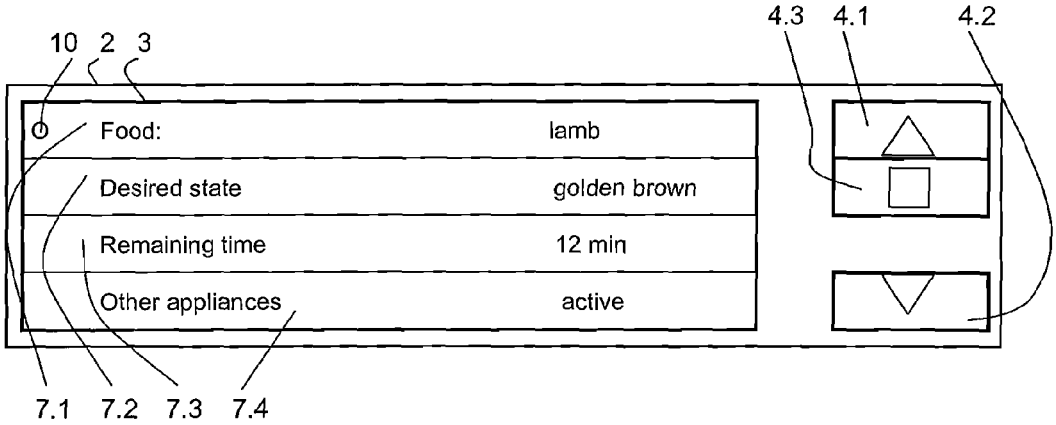
Figure 2C:
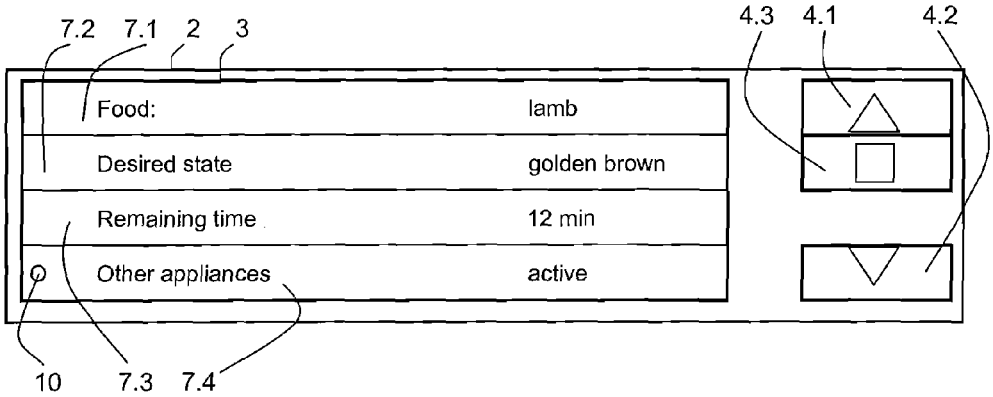
Figure 2D:
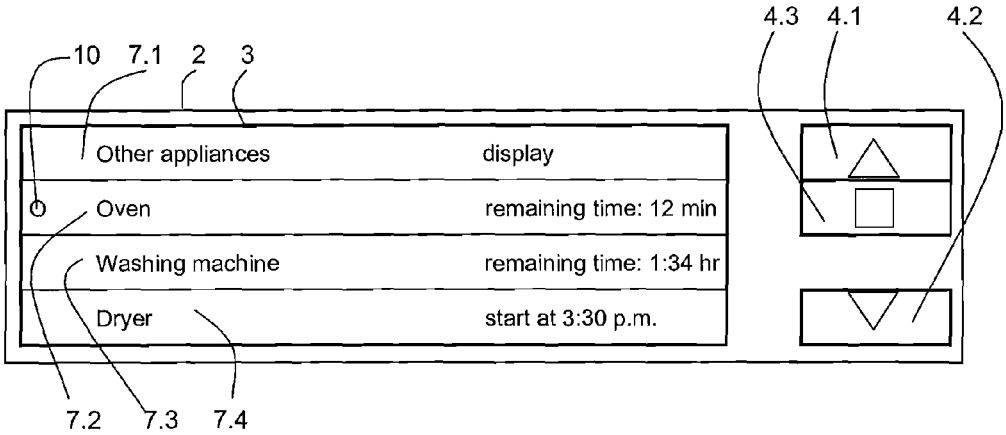

In FIG. 2*b*, the oven 1 is switched on, fields 7.1 and 7.2 show the program or parameter settings. Field 7.3 shows the remaining time for the baking procedure. Field 7.4 shows the combined information as "Other appliances active" when one or more remote appliances 5.1, 5.2 are switched on or are in operation. The button 4.2 can be used to move the cursor 10, for instance, in order to show parameters in field 7.2 from which to choose. As can be seen in FIG. 2*c*, the cursor 10 has been moved to field 7.4. By subsequently pressing the enter button 4.3, field 7.4 is selected or activated. In this process, the display 3 changes, so that, as shown in FIG. 2*d*, the status of each individual appliance is shown in a general form. With this display selection, a separate display field, in this example a line, is provided for each household appliance 5.1, 5.2 that is connected to the first household appliance 1. In the example shown, field 7.2 is reserved for the oven 1, where only the display of the status, here the remaining time for the ongoing baking procedure, is shown. Field 7.3 is reserved for the display of a remote household appliance, here the washing machine 5.1. In this example, the washing machine program has started, and the remaining running time is shown as the status. Field 7.4 is reserved for another remote household appliance, in this example the dryer 5.2, that has been placed on standby by means of the start pre-selection. The starting time for the drying program is output in field 7.4 as the status. The cursor remains in field 7.2, which is provided for the oven 1, that is to say, the first household appliance. By pressing the enter button 4.3 again, the display 3 is reset as shown in FIG. 2*c*, so that the statuses and/or settings of the first household appliance 1 are shown in fields 7.1, 7.2 and 7.3. The statuses of the remote household appliances 5.1, 5.2 are shown again as a group message in field 7.4. Therefore, field 7.4 only indicates whether a remote household appliance 5.1, 5.2 is in operation at all.

Figure 3A:
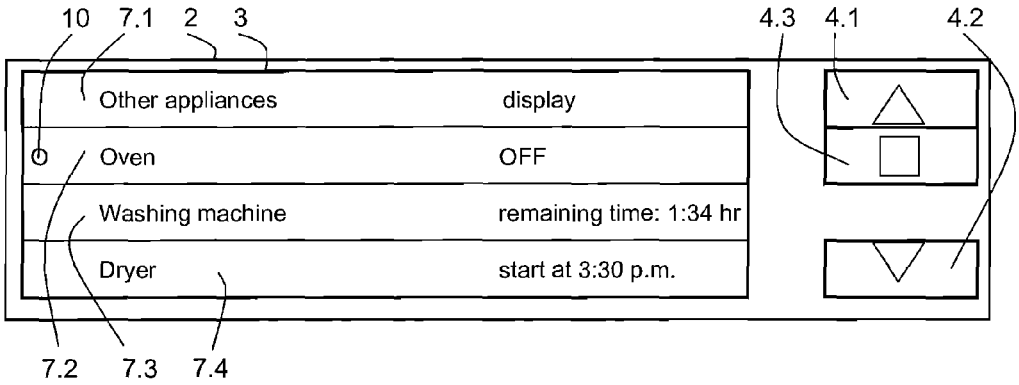
FIGS. 3*a*-3*b*—an operating and display device in a different status.
Figure 3B:
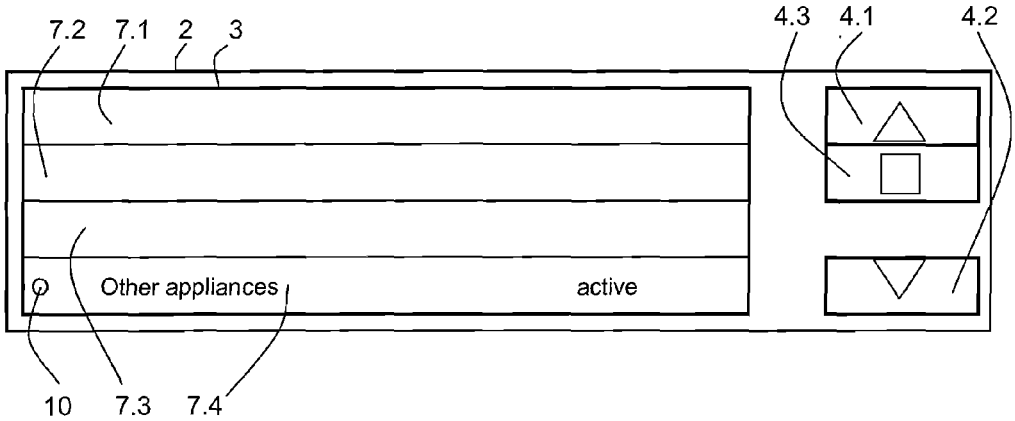

FIG. 3*b* depicts the case in which the oven 1 is not in operation but the remote household appliances, in other words, the washing machine 5.1 and the dryer 5.2, are. In this case, the display 3 of the first, inactive household appliance can be activated through the actuation of the operating element 4. As already described above, the cursor can be moved to field 7.4 using buttons 4.1, 4.2, this field being provided for the combined information about the statuses of the remote household appliances 5.1, 5.2. When the enter button 4.3 is pressed, the display 3 is changed so that, as shown in FIG. 3*a*, the status of each individual appliance is shown in a general form. With this display selection, a separate display field, in this example a line, is provided for each household appliance 5.1, 5.2 that is connected to the first household appliance 1. Field 7.2 indicates "oven OFF" as the status of the first household appliance 1. Fields 7.3 and 7.4 show the statuses of the remote household appliances 5.1 and 5.2, as already depicted and described in FIG. 2*d*. The cursor 10—as the selection indicator—remains permanently associated with the first household appliance, which is indicated as "oven" in the display 3, although the latter is switched off. When the enter button 4.3 is pressed, the display 3 is reset to display the status and/or settings of the first household appliance 1. Subsequently, the situation depicted in FIG. 3*b* occurs. Since the first household appliance is switched off, all of the fields 7.1 to 7.3 provided for this purpose, are darkened or switched off, as shown in FIG. 3*b*. Only field 7.4, which shows the combined information for the statuses and/or settings of the remote household appliance, remains on or is active.

In a practical embodiment, this display 7.4 also goes out after a certain time delay. Only when the operating element 4 is activated or when there is a status change in the program course of a remote household appliance is the display 3 with field 7.4 activated.

In other embodiments, the operation element is configured as a rotary knob with which the cursor can be moved. The chosen display option is selected using a pushbutton arranged on the rotary knob or else by pressing the rotary knob. A so-called touchscreen can also be employed as the operating element, whereby touching the field causes the setting associated with that field to be selected or else causes the function associated with that field to be carried out. In the context shown in FIG. 2*c*, touching field 7.4 containing the combined information for the remote household appliances 5.1, 5.2 would cause the display to change as shown in FIG. 2*d*. According to this figure, a respective display field 7.1, 7.2 is provided for each household appliance 5.1, 5.2. The display shown here with four lines is only presented by way of example, displays with five or more lines can also be used. When more remote household appliances are used than there are fields or lines that can be shown in the display 3, a so-called scroll function is activated. For instance, if four remote household appliances were used, the display option as depicted in FIG. 2*d* or 3*a* would not show the status and/or settings of two household appliances. Pressing the arrow button 4.2 would transfer the display from field 7.4 to field 7.3, whereby field 7.4 would then show the remote household appliance that had not been displayed before. Pressing the arrow button 4.1 would transfer the original content or the plain text output from field 7.3 to field 7.4. Then field 7.3 would again show the original display for the first remote household appliance. Consequently, there is no need to adapt display 3 in terms of the number of lines or fields 7.1 to 7.4 to the employed number of remote household appliances 5.1, 5.2 that are to be displayed.

Likewise conceivable as remote household appliances 5.1, 5.2 are refrigerators and/or freezers. In this case, only undesired errors such as, for example, the condition of an impermissible temperature range or a door that is not properly closed can lead to a status message. The status messages can also be displayed differently in terms of their relevance, so that, for instance, undesired errors are accompanied by acoustic signals so as to alert an operating person. Changes in the statuses of the remote appliances 5.1, 5.2 can also be displayed or made known in this manner. In a practical fashion, the normal, error-free operation of a refrigerator and/or freezer would not appear as "active" status on field 7.4 with the group message 11. Thus, the group message 11 remains primarily reserved for the household appliances that are only active at certain times such as, for instance, washing machines, dishwashers.

Figure 4:
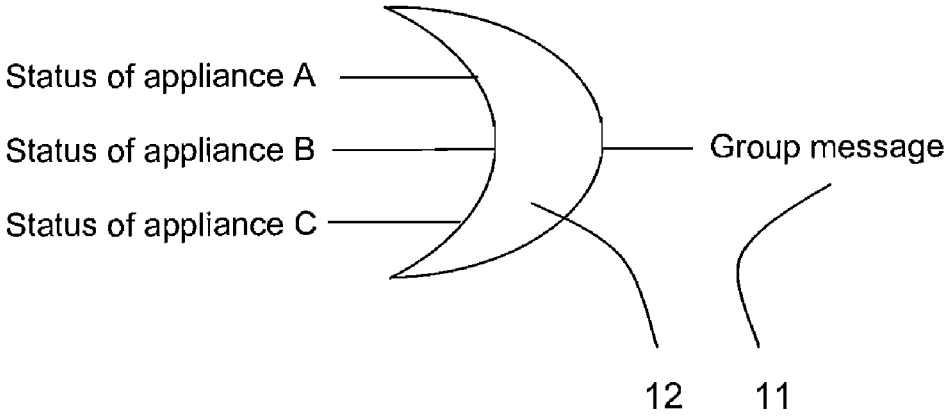
FIG. 4—the mode of operation of the group message, schematically.

FIG. 4 shows in schematic form by way of an example how combined information is formed. By means of an OR logic operation 12, the individual status displays are linked to form a single group message 11. This group message 11 or the combined information indicates whether one or more statuses of remote household appliances are to be displayed. This means that an active status for appliance A and inactive statuses for appliance B and appliance C yields an active group message 11. Also an active status or a status to be displayed for appliance B or appliance C yields an active group message. Only when every appliance, in other words, appliance A, appliance B and appliance C each reports or has an inactive status does the result of the OR operation 12 issues an inactive group message 11.

What is claimed is:

1. An operating and display device for a household appliance, comprising:

a display including a plurality of display areas, a first display area of the display areas being configured to show summary information, the summary information being a single group message representative of a combination of a respective status or setting of each of a plurality of other household appliances connected so as to communicate with the household appliance, the display being configured to display at least one of a status and a setting of the household appliance; and an operating element configured to select at least one of an operating program, a parameter and a display option, the operating element being configured to select the at least one of a status and a setting of the household appliance;

wherein the operating and display device is integrated into the household appliance, and the other household appliances are disposed remotely, wherein the household appliance and the other household appliances include at least one of a washing machine, a dryer, an oven, a microwave oven, a stove, a dishwasher, a refrigerator and a freezer.

2. The operating and display device as recited in claim 1 wherein the respective status or setting of the other household appliances is combined using an OR logic operation so as to provide the summary information.

3. The operating and display device as recited in claim 1 wherein the display includes a second display area selectable using the operating element so as to selectably display a respective status of the other household appliances.

4. The operating and display device as recited in claim 2 wherein the display includes a second display area selectable using the operating element so as to selectably display a respective status of the other household appliances.

5. The operating and display device as recited in claim 3 wherein the display is configured to display in a third display area the status of the household appliance simultaneously with a displaying of the respective status of the other household appliances in the second display area.

6. The operating and display device as recited in claim 4 wherein the display is configured to display, in a third display area, the status of the household appliance simultaneously with the respective status of the other household appliances.

7. A household appliance having an operating and display device, the operating and display device comprising:

a display including a plurality of display areas, a first display area of the display areas being configured to show summary information, the summary information being a single group message representative of a combination of a respective status or setting of each of a plurality of other household appliances connected so as to communicate with the household appliance, the display being configured to display at least one of a status and a setting of the household appliance; and an operating element configured to select at least one of an operating program, a parameter and a display option, the operating element being configured to select the at least one of a status and a setting of the household appliance;

wherein the operating and display device is integrated into the household appliance, and the other household appliances are disposed remotely, wherein the household appliance and the other household appliances include at least one of a washing machine, a dryer, an oven, a microwave oven, a stove, a dishwasher, a refrigerator and a freezer.

8. A system comprising:

a first household appliance and a plurality of other household appliances, the first household appliance having an operating and display device comprising:

a display including a plurality of display areas, a first display area of the display areas being configured to show summary information, the summary information being a single group message representative of a combination of a respective status or setting of each of the plurality of other household appliances connected so as to communicate with the first household appliance, the display being configured to display at least one of a status and a setting of the household appliance; and an operating element configured to select at least one of an operating program, a parameter and a display option, the operating element being configured to select the at least one of a status and a setting of the household appliance;

wherein the operating and display device is integrated into the household appliance, and the other household appliances are disposed remotely, wherein the household appliance and the other household appliances include at least one of a washing machine, a dryer, an oven, a microwave oven, a stove, a dishwasher, a refrigerator and a freezer.

9. An operating and display device for a household appliance, comprising:

a display including a plurality of display areas, a first display area of the display areas being configured to show summary information, the summary information being based on a combination of a respective status or setting of each of a plurality of other household appliances connected so as to communicate with the household appliance; and an operating element configured to select at least one of an operating program, a parameter and a display option, wherein the respective status or setting of the other household appliances is combined using an OR logic operation so as to provide the summary information, wherein the household appliance and the other household appliances include at least one of a washing machine, a dryer, an oven, a microwave oven, a stove, a dishwasher, a refrigerator and a freezer.

10. The operating and display device as recited in claim 9 wherein the display includes a second display area selectable using the operating element so as to selectably display a respective status of the other household appliances.

11. The operating and display device as recited in claim 10 wherein the display is configured to display in a third display area the status of the household appliance simultaneously with a displaying of the respective status of the other household appliances in the second display area.

12. The operating and display device as recited in claim 11 wherein the display is configured to display, in a third display area, the status of the household appliance simultaneously with the respective status of the other household appliances.

* * * * *